US005242085A

United States Patent [19]

Richter et al.

[11] Patent Number: 5,242,085

[45] Date of Patent: Sep. 7, 1993

[54] LIQUID CONTAINER SYSTEM

[75] Inventors: Simon J. Richter, Marietta; Gary V. Paisley, Lilburn, both of Ga.

[73] Assignee: The Coca-Cola Company, Atlanta, Ga.

[21] Appl. No.: 803,241

[22] Filed: Dec. 5, 1991

Related U.S. Application Data

[63] Continuation-in-part of Ser. No. 628,819, Dec. 17, 1990, abandoned.

[51] Int. Cl.[5] ..... B65D 35/28; B65D 83/00; B67D 1/00

[52] U.S. Cl. ..... 222/105; 222/386.5; 222/183; 220/461; 215/1 C; 428/35.2

[58] Field of Search ..... 220/461, 462; 222/94, 222/95, 105, 107, 183, 386.5; 383/80; 53/175; 428/35.2, 34.7, 12; 215/1 C, 12.2

[56] References Cited

U.S. PATENT DOCUMENTS

| | | | |
|---|---|---|---|
| 2,715,980 | 8/1955 | Frick | 222/183 |
| 2,732,977 | 1/1956 | Charpiat . | |
| 3,040,933 | 6/1962 | Everett | 222/95 |
| 3,118,572 | 1/1964 | Harding . | |
| 3,161,327 | 12/1964 | Kraus . | |
| 3,178,062 | 4/1965 | Weety et al. . | |
| 3,239,102 | 3/1966 | Heydon et al. . | |
| 3,409,714 | 11/1968 | Strugar, Jr. | 222/105 X |
| 3,484,011 | 12/1969 | Greenhalgh et al. | 222/183 X |
| 3,592,360 | 7/1971 | Aleck | 222/95 |
| 3,727,783 | 4/1973 | Carmichael . | |
| 3,765,574 | 10/1973 | Urquiza | 222/183 |
| 3,876,119 | 4/1975 | Lamkin | 222/386.5 |
| 3,940,001 | 2/1976 | Haefner et al. . | |
| 3,945,539 | 3/1976 | Sossong . | |
| 4,008,830 | 2/1977 | Meshberg . | |
| 4,008,831 | 8/1977 | Vidilles | 222/105 X |
| 4,286,636 | 9/1981 | Credle, Jr. . | |
| 4,350,227 | 9/1982 | Petterson | 222/386.5 |
| 4,463,875 | 8/1984 | Tepic | 222/94 X |
| 4,482,588 | 11/1984 | Fagerburg et al. . | |
| 4,484,697 | 11/1984 | Fry, Jr. . | |
| 4,501,781 | 2/1985 | Kushida et al. . | |
| 4,550,043 | 10/1985 | Beck . | |
| 4,609,516 | 9/1986 | Krishnakumar et al. | 425/130 X |
| 4,646,925 | 3/1987 | Nohara . | |
| 4,696,840 | 9/1987 | McCullough et al. | 222/105 X |
| 4,723,688 | 2/1988 | Munoz . | |
| 4,796,788 | 1/1989 | Bond . | |
| 4,881,666 | 11/1989 | Tullman et al. . | |
| 4,892,230 | 1/1990 | Lynn, Jr. . | |
| 4,921,135 | 5/1990 | Pleet . | |
| 4,966,543 | 10/1990 | Krishnaukumar et al. | 425/522 |
| 4,972,969 | 11/1990 | Randklev | 222/94 X |
| 4,979,631 | 12/1990 | Krishnaukumar et al. | 215/1 C X |
| 4,980,100 | 12/1990 | Krishnakumar et al. | 264/25 |
| 5,037,002 | 8/1991 | Tschanen | 222/105 |

FOREIGN PATENT DOCUMENTS

| | | |
|---|---|---|
| 570451 | 9/1958 | Belgium . |
| 0182094 | 5/1986 | European Pat. Off. . |
| 3618634 | 12/1987 | Fed. Rep. of Germany . |
| 2164825 | 8/1973 | France . |
| 1032825 | 6/1966 | United Kingdom . |
| 1171612 | 11/1969 | United Kingdom . |
| 1455453 | 11/1976 | United Kingdom . |

*Primary Examiner*—Andres Kashinikow
*Assistant Examiner*—Kenneth DeRosa
*Attorney, Agent, or Firm*—Thomas R. Boston; W. Dexter Brooks

[57] ABSTRACT

A syrup container system for post-mix beverage dispensing systems comprising filling a blow molded, multi-layer PET container with syrup and connecting the container to a post-mix beverage dispenser through a syrup pump. The PET container includes a release agent such as a layer of EVOH located outside of the inner PET layer and an air vent partway through the container wall terminating at the inner PET layer or at the adjacent release layer, so that the inner PET layer can separate from the remainder of the wall and collapse around the remaining syrup as it is withdrawn, without the need for venting the syrup chamber to atmosphere. The PET container also includes a polyethylene closure sealing the container opening and coupling means for connecting to a quick-disconnect coupling on the distal end of a syrup line. The PET container is disposable and recyclable.

24 Claims, 4 Drawing Sheets

LIQUID CONTAINER SYSTEM

CROSS-REFERENCE TO RELATED APPLICATION

This application is a continuation-in-part to U.S. patent application Ser. No. 07/628,819, filed Dec. 17, 1990, now abandoned and having the same title, inventors and assignee.

BACKGROUND OF THE INVENTION

The present invention relates to a blow molded plastic container of laminated construction for syrup or flavor concentrate suitable for use with a post-mix beverage dispenser. More specifically, the present invention relates to a disposable and recyclable container for supplying syrup or flavor concentrate, said container being connectable to a syrup pump which withdraws the syrup or flavor concentrate from the container by suction and feeds it to a post-mix dispenser.

In post-mix beverage dispensers, such as those used in fast-food restaurants or the like, the syrup is presently supplied from either a reusable stainless steel, pressurized container with a five-gallon capacity, or a disposable bag-in-box type of container. The stainless steel type of container is known as a "figal", an accepted abbreviation in the beverage dispensing art for a syrup container with a five-gallon capacity fabricated primarily of stainless steel. "Figal" containers are generally described in U.S. Pat. No. 3,186,577 to Tennison. Because the figal container must be strong enough to withstand the $CO_2$ pressure used to pressurize the Figal to force the syrup to the dispenser, it is relatively expensive to manufacture, and it must be kept after use and then returned to the syrup supplier, where it is sanitized and reused.

In contrast, bag-in-box packages for syrup are disposable, more convenient and less expensive. However, known bag-in-box type packages are not easily recyclable because of the many different materials used therein including the outer shrink wrap, the paperboard box, the two layer bag, the spout, the dipstrip, and the valve. Thus, an associated waste disposal problem results. A typical bag-in-box type package is disclosed in U.S. Pat. No. 4,286,636 to Credle.

Bag-in-box packages of the general type disclosed in the Credle '636 Patent are in wide use today in beverage dispensing systems which include gas-operated reciprocating pumps in the syrup line between the bag-in-box package and the dispenser. The syrup line is connected to the bag by a quick-disconnect coupling. An example of such a quick-disconnect coupling is also illustrated in the Credle '636 Patent.

Accordingly, a need exists in the art for a disposable, inexpensive syrup container for use with post-mix beverage dispensers, which is also recyclable.

SUMMARY OF THE INVENTION

The liquid container system of the present invention comprises filling a PET container with syrup and connecting the syrup container to a post-mix beverage dispenser through a bag-in-box syrup pump. The syrup container includes a wall, a container opening, an air vent or a plurality of air vents, and a PET closure connected to the container opening. The wall preferably includes an outer and an inner PET layer and a release agent therebetween, such as a layer of EVOH. As syrup is withdrawn from the container, the inner PET layer separates from the outer PET layer and collapses around the remaining syrup, eliminating the need for venting the syrup chamber to atmosphere. When all of the syrup has been evacuated, a vacuum is drawn so that existing bag-in-box sold-out devices can be used. After use, the PET container is disposable and can be recycled.

It is a primary object of the present invention to provide a syrup container system for post-mix beverage dispensing using a disposable and recyclable plastic syrup container in lieu of a conventional bag-in-box type of container.

It is another object of the present invention to provide a syrup container system using a disposable and recyclable syrup container which can be used with the same identical equipment used with bag-in-box type containers, including the same syrup pump, sold-out device, and quick-disconnect coupling.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

With reference now to the drawings, FIGS. 1–10 show the liquid container system of the present invention.

Figure 5:
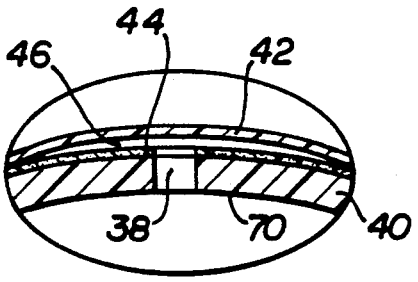
FIG. 5 is a view identical to FIG. 2 but showing the separation occurring at the beginning of product evacuation from the container.
Figure 6:
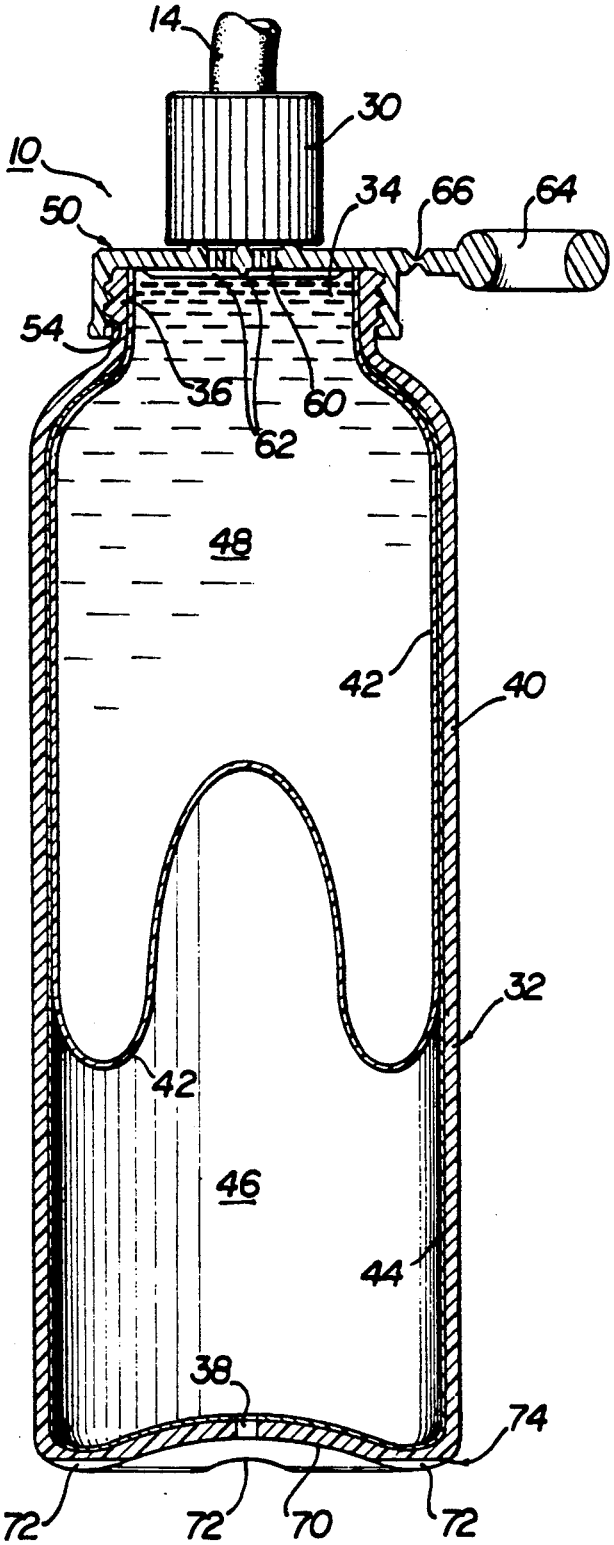
FIG. 6 is a cross-sectional view of the container of FIG. 1 after partial evacuation of the syrup therefrom.
Figure 7:
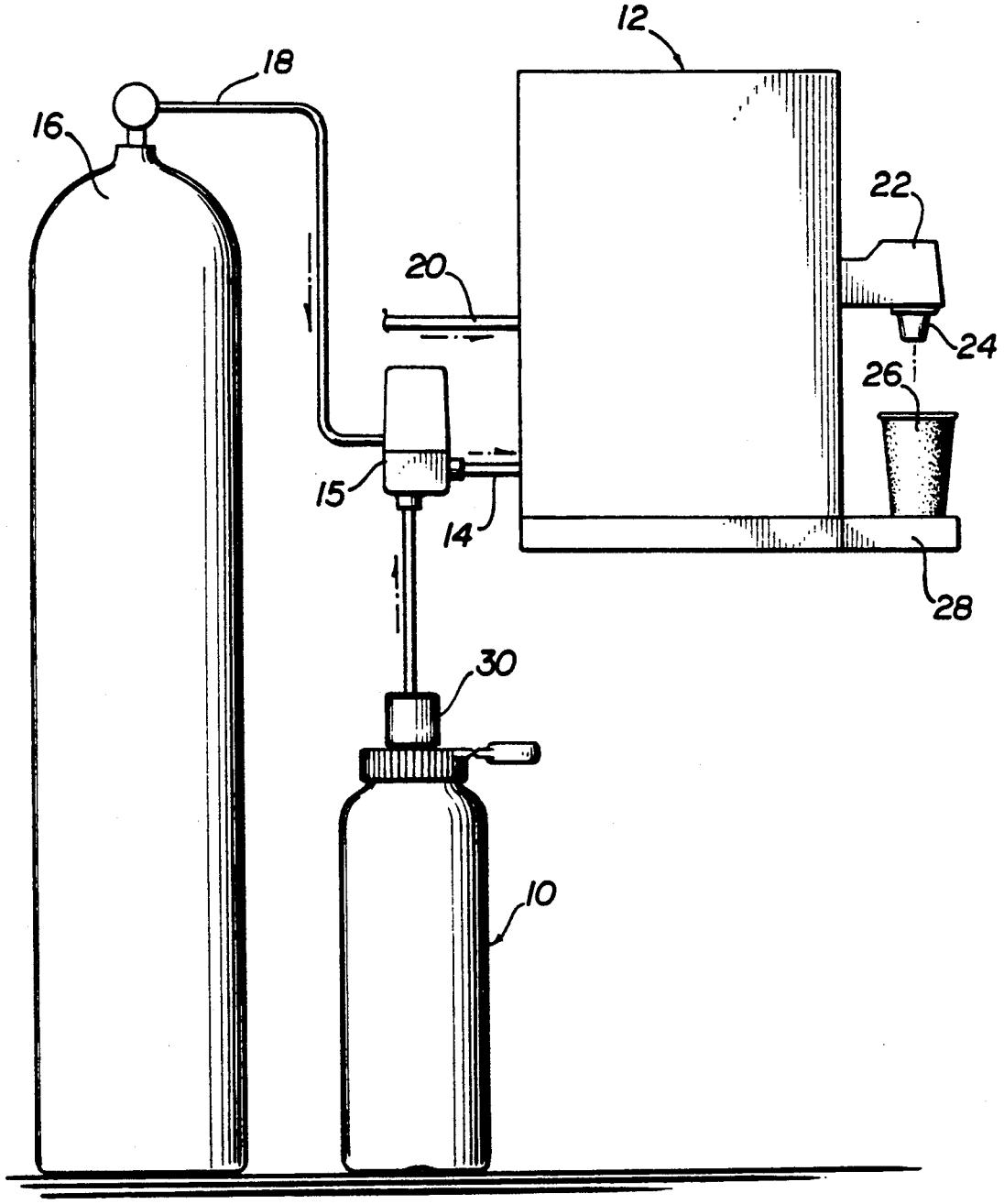
FIG. 7 is a partly schematic, partly diagrammatic view of a syrup container system according to the present invention.
Figure 8:
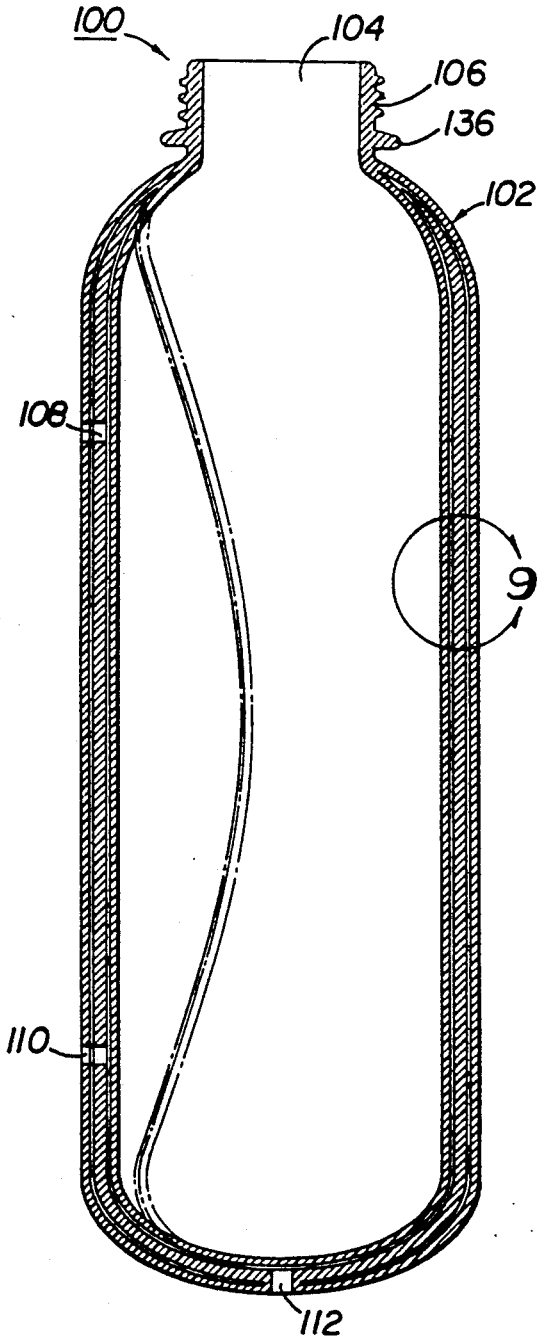
FIG. 8 is a cross-sectional view through a container according to a preferred embodiment of this invention.
Figure 10:
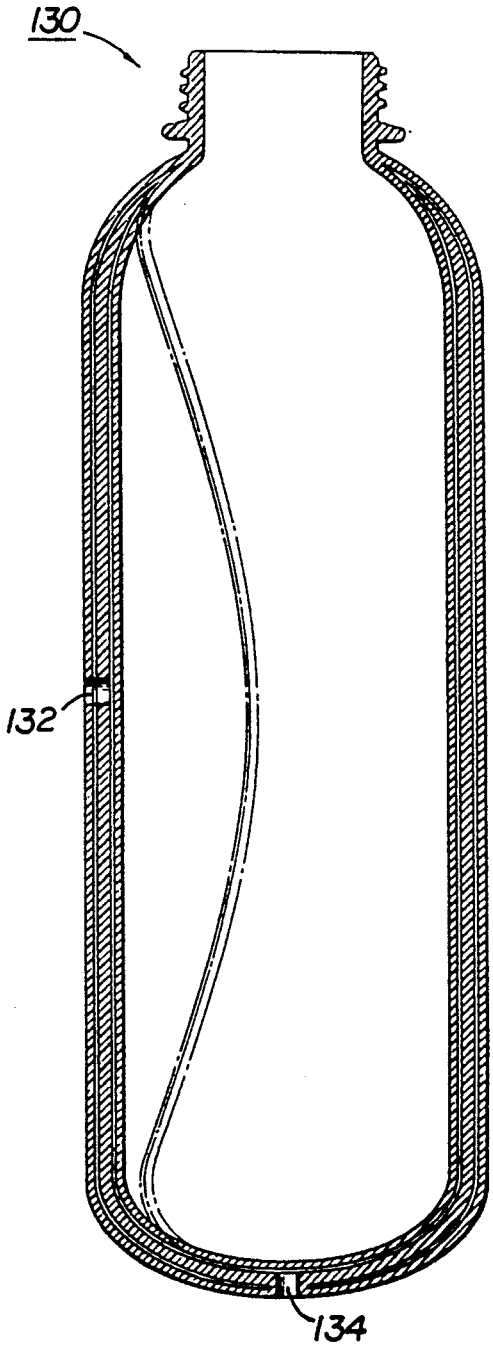
FIG. 10 is a view like FIG. 8 of another container of this invention.
Figure 9:
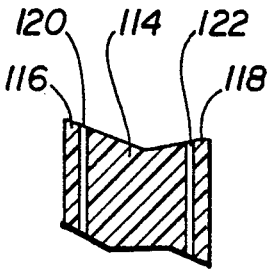
FIG. 9 is an enlarged, partial cross-sectional view through a portion of the wall of the container of FIG. 8.

FIGS. 1–6 show the details of a PET syrup container 10 according to one embodiment of the present invention, FIG. 7 shows the use of the container 10 to supply syrup 48 (see FIG. 2) to a post-mix beverage dispenser 12, FIGS. 8 and 9 show a container according to a preferred embodiment of this invention and FIG. 10 shows another container of this invention.

Referring to FIG. 7, a syrup tube or line 14 connects the container 10 to the dispenser 12 with a syrup pump 15 in the line. The pump 15 is typically operated by gas such as by being connected to a $CO_2$ source 16 through a $CO_2$ line 18. The dispenser 12 is any well-known dispenser and includes an inlet water line 20 connected thereto and includes a plurality of beverage dispensing valves 22 for dispensing a selected beverage from a nozzle 24 into a cup 26 located on a drip tray 28. The syrup line 14 is attached to the container by a known quick-disconnect coupling 30 on the distal end of the line 14.

Referring to FIGS. 1–6, the container 10 includes a wall 32, a container opening 34 (for filling and evacuation) surrounded by a neck 36, an air vent 38 extending partway through the wall, and a closure 50. The wall includes an outer PET layer 40, an inner PET layer 42, and a release agent therebetween such as a layer 44 of EVOH.

The EVOH layer is known for use as an oxygen barrier and in such cases an adhesive layer is used on both sides of the EVOH layer. However, in the container 10, the release layer 44 can be EVOH but the EVOH does not have to have barrier properties, just release properties. In the container 10, no adhesive layer is needed, although it can be used on one side only of the EVOH layer, if desired. In the preferred embodiment, there is no adhesive between the EVOH and the inner PET layer.

Figure 4:
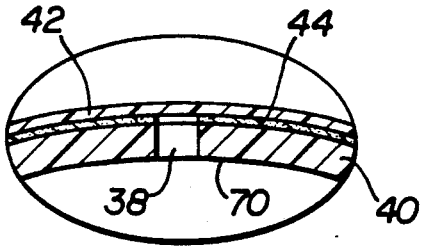
FIG. 4 is an enlarged, partial cross-sectional view through the air vent area of the container of FIG. 1 as it appears after manufacture.

FIG. 4 shows the area around the air vent 38 before evacuation begins. FIG. 5 shows what happens when evacuation begins and the inner layer 42 begins to separate from the outer layer 40 and the EVOH layer 44 producing an air space 46 therebetween.

FIG. 6 shows what happens after partial evacuation. The inner layer 42 simply separates from the outer and EVOH layers and surrounds the remaining syrup, similarly to what happens in the present bag-in-box system of a plastic bag in a paperboard box.

Certain features of the present invention will now be described in detail.

After the container 10 is filled with syrup through the container opening 34, a closure 50 is attached to the neck 36 of the container. Between the time of manufacture and filling, a dust cap (not shown) may be attached to cover the container opening, if desired. The closure includes a cap 52 screw threaded thereon and which is removed when the quick-disconnect coupling 30 is to be attached to the container.

The closure 50 includes screw threads 54 for connecting to the container 10 and screw threads 56 for connecting to the syrup line coupling 30. The screw threads 54 on the closure and/or the screw threads on the neck 36 are preferably ratchet type so that the closure 50 cannot be removed. The screw threads 56 are the same as used now on bag-in-box bag valves for connecting to known syrup couplings.

Figure 1:
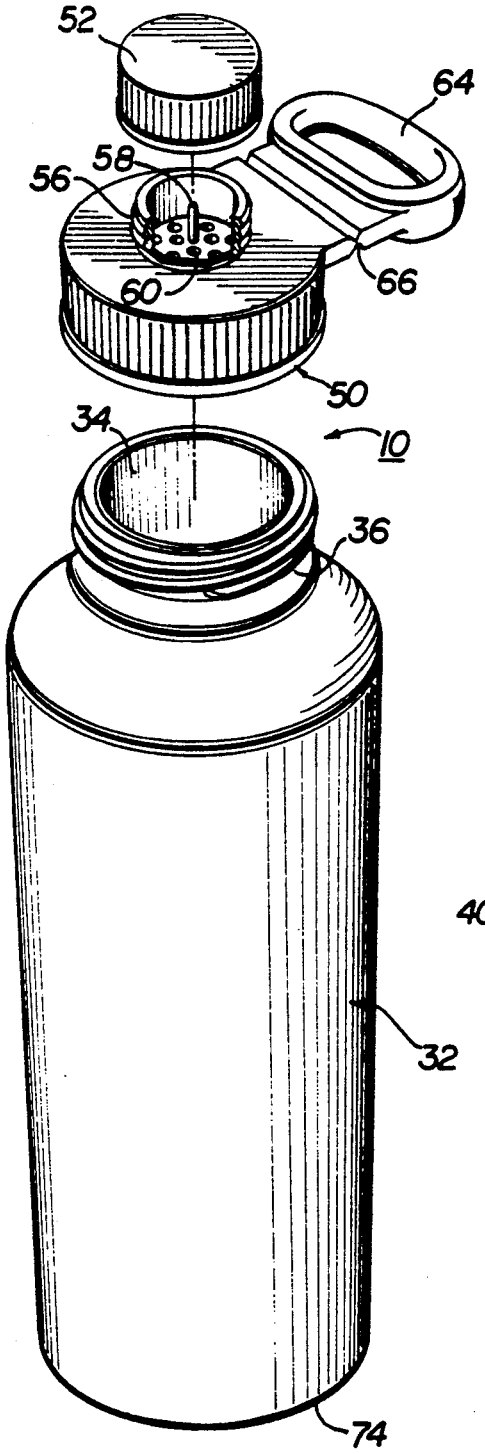
FIG. 1 is a perspective view of a container according to the present invention.
Figure 2:
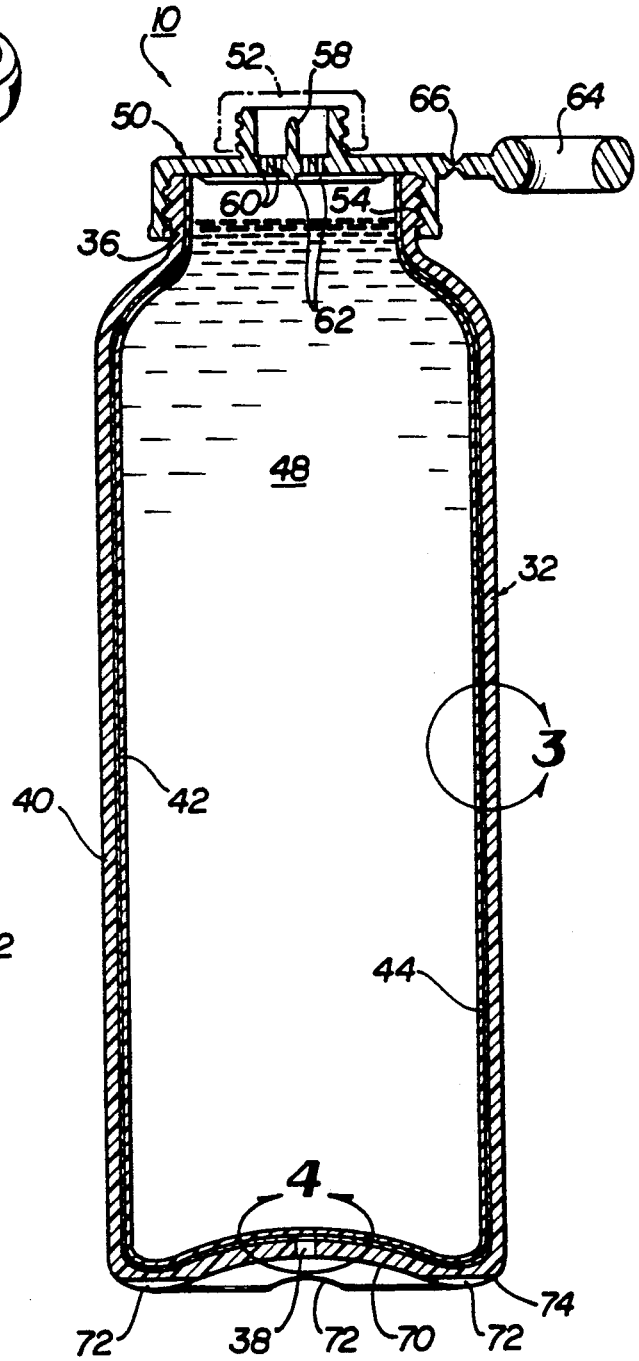
FIG. 2 is a cross-sectional view of a syrup container according to the present invention.

The coupling 30 includes a pin 58 to actuate (open) the valve (not shown) in the coupling 30 in the manner known in the art as the coupling 30 is attached to the closure 50. The closure 50 includes an opening 60 for evacuating the syrup therefrom when the pump is energized. In the preferred embodiment the opening 60 includes a plurality of small holes as shown in FIG. 2. The advantage of the opening 60 being a plurality of holes is that it makes unauthorized refilling difficult. The closure 50 also includes means for preventing the inner layer 42 from collapsing against and closing off the opening 60 prior to all of the syrup being evacuated. In a preferred embodiment this means includes a plurality of ribs 62, although other means such as dip tubes, dip strips and perforated hollow cylinders can be used, as desired. The closure 50 also preferably includes a handle 64 preferably molded or formed as part of the closure. The handle can include a weakened area to act as a hinge 66 for the handle. The ribs 62 can have whatever dimensions are found to work best to achieve the above-stated purpose.

The bottom of the container 10 includes the air vent 38, which is preferably about ⅜ inch in diameter. Various spacer means can be used to ensure free flow of air into the air vent such as a concave bottom wall 70 surrounded by an annular base 74 with a plurality, preferably four, small radial air slots 72 in the bottom surface of the annular base 74. While this is the preferred arrangement, alternatively the container bottom can be convex and a separate base cup with air openings can be added to the container to keep the air vent 38 from being closed off by contact with the floor.

Figure 3:
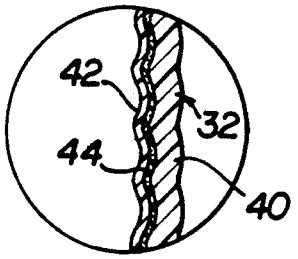
FIG. 3 is an enlarged, partial view of a portion of the container of FIG. 2.

To provide additional strength to the container 10, the wall (at least the elongated portion thereof between the neck and the base) can be provided or formed with strengthening ribs as shown in FIG. 3. Any known form of strengthening ribs can be used. Those shown are very gently curving, with the radial distance from crest to valley being about ⅛ to ¼ inch and the vertical distance from crest to crest being about three to four times the radial distance or about ½ to 1 inch. Vertically extending ribs would be preferred, having a distance of about one inch from crest to crest and a depth of about ⅛ inch.

The container 10 is preferably cylindrical with a diameter of about 8 inches and a height of about 27 inches to hold five gallons of syrup. The inner and outer walls are preferably of PET and the release layer is preferably EVOH. The outer layer is preferably about 0.02 to 0.025 inch thick. The inner layer is preferably about 0.0015 to 0.0030 inch thick. The EVOH layer is preferably about 0.001 inch thick. The container opening 34 is preferably about 50 mm. in diameter. The wall 32 of the container is thicker at the neck 36 (about ⅛ inch) similar to the thickness variation in present PET bottles.

The air vent 38 extends through the outer and middle layers but not through the inner layer 42. This air vent hole can be produced in any desired manner, such as by drilling after manufacture or forming during manufacture (forming is preferred).

The three layers are laminated together but the bonding between the inner layer 42 and the EVOH layer 44 is weak such that as syrup is evacuated from the container 10, the inner layer will separate from the EVOH layer as shown in FIGS. 5 and 6. The EVOH layer could separate from the outer layer and stay with the inner layer, but that is not the preferred embodiment. For other release agents, the release agent may not even be a separate layer of material. Preferably, the EVOH layer 44 stops short of the top edge of the neck 36 and the inner and outer layers are bonded together in this area to prevent separation or delamination. The EVOH layer can stop as low as about one-half way up the height of the container, however, preferably it extends all the way up to just short of the neck. Thus, the container wall includes a delaminatable portion where the EVOH layer is located and a non-delaminatable portion where there is no EVOH layer, such as at the neck.

FIGS. 8 and 9 show a container 100 according to a preferred embodiment of this invention. The container 100 is similar to the container 10 of FIGS. 1–7 and can be used in the same way.

The container 100 includes a wall 102, a container opening 104 surrounded by a neck 106 and three air vents 108, 110 and 112 extending partway through the wall. The wall 102 includes a thick, main central PET layer 114 and thin inner and outer PET layers 116 and 118, respectively, with thin inner and outer layers 120 and 122, respectively, of release agent (preferably EVOH) between the thin layers and the main layer. The container 100 preferably has vertical ribs for strength.

The differences between the container 100 and the container 10 are that the container 100 has two additional air vents 108 and 110 (preferably about ¼ inch in diameter) and that there is an additional PET layer 118 on the outside of the main PET layer 114 with an additional layer 122 of EVOH therebetween as shown in FIG. 9. The inner and outer wall layers 116 and 118 preferably have a thickness of about 0.0015 to 0.0030 inch, the main layer 114 is preferably about 0.02 to 0.025 inch thick. The EVOH is preferably about 0.001 inch thick.

When the container 10 or 100 is placed horizontally in use, the air vent 38 or 112 is sufficient. However, when placed vertically, the weight of the syrup can keep the air vent 38 closed and the entire container 10 could collapse as the syrup is withdrawn. The purpose for the additional air vents 108 and 110 is to prevent such collapse and to ensure that the inner layer 116 collapses and releases from the remainder of the wall of the container. Preferably, one air vent 108 is toward the top and one air vent 110 is toward the bottom of the container 100. The air vents 108 and 110 are preferably axially spaced-apart and approximately in-line circumferentially.

In the portion of the container wall surrounding the opening 104, the wall is all PET, with no EVOH, as shown in FIG. 8.

The container 100 preferably has vertical (axially extending) ribs for strength, although it can also have circumferential ribs in addition to the vertical ribs.

FIG. 10 shows a container 130 like container 100 except that it has only one side air vent 132 plus a bottom air vent 134.

The air vents can be formed in any desired fashion, including drilling, and terminate at the inner PET layer 116, that is, they terminate directly at the inner layer or in or at the inner EVOH layer adjacent the inner PET layer. The air vents extend through the rest of the layers, including the other PET layer or layers and any other release layer(s). The air vents preferably extend through the EVOH layer adjacent the inner PET layer, although this is not essential.

The containers are preferably manufactured by blow molding from laminated preforms using any well-known stretch and blow process from a coextruded preform, as described, for example, in U.S. Pat. Nos. 4,032,341 and 4,609,516.

The containers can be used in any position, but vertical is preferred. No container valve is required, unless the coupling is to be connected while the container is horizontal. The containers can be used with the same exact equipment presently used with the existing bag-in-box syrup container.

While the preferred embodiment of this invention has been described above in detail, it is to be understood that variations and modifications can be made therein without departing from the spirit and scope of the present invention. For example, while various numbers of PET layers have been shown, additional layers can be used, if desired. While various air vents have been shown, others can be used and in different locations, if desired. The wall layers 40, 42, 114, 116 and 118 are preferably all made of PET and the closing of polyethylene for ease of recycling. While a particular handle has been shown, others can be used, such as one separate from the closure to connect to the bottle under the flange 136. The containers are preferably cylindrical although other shapes such as cubical (with rounded corners) or spherical can be used. While the preferred container size is five gallons, the container can be made in any desired size, such as one gallon, two gallon, etc. The preferred application is for use with syrup in post-mix beverage dispensing; however, other liquids and other applications can be used. The container is preferably disposable, although it can be reused by blowing the inner layer back to its original position and shape, cleaning and refilling. Other plastics than PET and other release layers or agents than EVOH can be used. For example, depending on the use of the container, other plastic materials such as certain nylons, copolyesters, polypropylene (PP), PP/PET blends, polyacrylonitrile, polycarbonate and the like can be used. When using a plurality of air vents, it is preferred to have one in the bottom wall of the container, although this is not essential. When using a plurality of air vents, it is not necessary to have the spacer means.

What is claimed is:

1. An article comprising:

(a) a liquid container including a wall, a container opening for filling and evacuating said container surrounded by a container neck, and an air vent extending partway through said wall;

(b) said wall including an outer PET layer and an inner PET layer, said wall including a delaminatable portion and a non-delaminatable portion, and a release agent located between said layers over said delaminatable portion of said container wall such that said inner layer can separate from said outer layer when liquid is evacuated from said container and air flows in through said air vent;

(c) said air vent extending through said outer layer and terminating at said inner layer, and said air vent being permanently open to atmosphere, such that air can flow through said air vent and in between said inner and outer PET layers as liquid is withdrawn from said container;

(d) said container including spacer means for maintaining said air vent open and out of contact with an external surface;

(e) said inner and outer PET layers being bonded directly together in said non-delaminatable portion of said wall and said non-delaminatable portion including said container neck;

(f) said container including a closure connected to said container neck and sealing said container opening closed;

(g) means for non-removably connecting said closure to said container; and (h) said closure including a liquid opening therethrough, a removable cap for closing said closure opening prior to connecting a coupling thereto, means for preventing said inner layer from sealing off said closure openings prior to complete liquid evacuation, and means for engaging and opening a valve in a quick-disconnect liquid coupling when connected to said closure.

2. The article as recited in claim 1 wherein said container wall includes a concave bottom wall surrounded by an annular base, said air vent being centrally located in said concave bottom wall, and including a plurality of air slots in said annular base to allow unrestricted air flow to said air 3. The article as recited in claim 2 wherein said closure opening includes a plurality of small holes, whereby refilling of said container through said non-removable closure would be time consuming.

4. The article as recited in claim 3 wherein said release agent comprises a layer of EVOH.

5. The article as recited in claim 4 wherein said outer PET layer has a thickness of about 0.025 inch, said EVOH layer has a thickness of about 0.001 inch, and said inner PET layer has a thickness in the range from about 0.0015 to 0.0030 inch.

6. The article as recited in claim 5 wherein said air vent extends through both said outer layer and said EVOH layer.

7. The article as recited in claim 6 wherein said container includes a plurality of circumferential ribs for added strength.

8. The article as recited in claim 1 wherein said release agent comprises a layer of EVOH.

9. The article as recited in claim 8 wherein said air vent is located on the bottom of said container and said container opening is located on the top of said container and wherein said container is generally cylindrical in shape.

10. The article as recited in claim 1 including an additional PET layer on the outside of said outer PET layer and an additional layer of release agent located between said outer PET layer and said additional PET layer.

11. The article as recited in claim 10 wherein said release agent is a layer of EVOH.

12. The article as recited in claim 11 wherein said outer PET layer has a thickness of about 0.025 inch, said EVOH layers having a thickness of about 0.001 inch, and said inner and said additional PET layers each have a thickness in the range of from about 0.0015 to 0.0030 inch.

13. The article as recited in claim 12 wherein said container includes a bottom wall and a sidewall and wherein said air vent is in said bottom wall, and including at least one additional side air vent in said sidewall extending through said additional PET layer, said additional EVOH layer, said outer PET layer and terminating at said inner PET layer, said at least one side air vent being permanently open to atmosphere.

14. The article as recited in claim 13 wherein said at least one side air vent includes two axially spaced apart side air vents.

15. The article as recited in claim 13 wherein said bottom wall air vent has a diameter of about $\frac{3}{8}$ inch and said at least one side air vent has a diameter of about $\frac{1}{4}$ inch.

16. The article as recited in claim 13 wherein said at least one side air vent consists of a single side air vent.

17. The article as recited in claim 16 wherein said single side air vent is centrally located in said sidewall between the top and bottom of said container.

18. The article as recited in claim 1 wherein said air vent has a diameter of about $\frac{3}{8}$ inch.

19. The article as recited in claim 1 wherein said container includes a bottom wall and a sidewall and wherein said air vent is in said bottom wall and including at least one additional side air vent in said sidewall.

20. An article comprising:

(a) a blow molded, multi-layer liquid container including a wall, a container opening for filling and evacuating said container surrounded by a container neck, and a plurality of air vents extending partway through said wall;

(b) said wall including a main plastic layer of PET and an inner plastic layer of PET, said wall including a release agent comprising a layer of EVOH located between said main and inner layers such that said inner layer can separate from said main layer when liquid is evacuated from said container and air flows in through said air vents;

(c) said air vents extending partway through said container wall and extending completely through said main layer and terminating at either said inner layer or said release agent, and said air vents being permanently open to atmosphere, such that air can flow through said air vents and in between said inner and main layers as liquid is withdrawn from said container; and (d) an outer PET layer on the outside of said main layer and an additional EVOH layer between said main and said outer layers.

21. The article as recited in claim 20 wherein said main layer has a thickness of about 0.025 inch, said inner and outer layers have a thickness of from about 0.0015 to 0.0030 inch, and said EVOH layers have a thickness of about 0.001 inch.

22. The article as recited in claim 21 wherein said container wall includes a bottom wall and a side wall, said air vents including one air vent located in said bottom wall, and at least one air vent located in said side wall.

23. The article as recited in claim 22 including a pair of axially spaced-apart air vents in said sidewall.

24. The article as recited in claim 22 wherein said bottom wall air vent has a diameter of about $\frac{3}{8}$ inch and said at least one sidewall air vent has a diameter of about $\frac{1}{4}$ inch.

* * * * *